United States Patent [19]

Stottman

[11] 4,146,223

[45] Mar. 27, 1979

[54] BOWLING LANE REPAIR

[76] Inventor: Thomas W. Stottman, 5605 Nally Ct., Louisville, Ky. 40216

[21] Appl. No.: 814,279

[22] Filed: Jul. 11, 1977

[51] Int. Cl.[2] ..... A63D 1/04

[52] U.S. Cl. ..... 273/51; 144/310 R; 144/318; 156/98

[58] Field of Search ..... 273/51; 52/514; 85/41; 144/310 R, 310 B, 313, 315, 318; 156/94, 98

[56] References Cited

U.S. PATENT DOCUMENTS

| | | | |
|---|---|---|---|
| 276,499 | 4/1883 | Story | 52/514 X |
| 1,167,774 | 1/1916 | Mentzer | 85/41 UX |
| 2,039,580 | 5/1936 | Borders | 273/51 |
| 2,512,469 | 6/1950 | Poss | 156/94 X |
| 2,969,983 | 1/1961 | De Vore | 273/51 |
| 3,014,722 | 12/1961 | Green | 273/51 |

*Primary Examiner*—Anton O. Oechsle
*Attorney, Agent, or Firm*—Wells, St. John & Roberts

[57] ABSTRACT

A kit for repairing a worn bowling lane following resurfacing of the lane to a predetermined minimum thickness. The kit includes a series of laminated wood panels fabricated from boards having a common width and thickness and used to rebuild a bowling lane when applied to the lane in abutting end-to-end positions. Wooden bolts are adapted to be received in apertures formed about the periphery of each panel to assure adhesive bonding between each panel and the bowling lane without the use of metal fasteners. The method involves the fabrication of the panels to match bowling lane requirements, the arrangement of the panels along the upper surface of the bowling lane, and the bonding of the panels to the lane by use of an adhesive. Temporary pressure is applied between the panels and the bowling lane by use of metal bolts. Permanent bonding is achieved by later substitution of wooden bolts, which are secured by adhesives. The enlarged heads of the wooden bolts are subsequently removed and sanded flush with the upper surfaces of the respective panels.

3 Claims, 7 Drawing Figures

BOWLING LANE REPAIR

BACKGROUND OF THE INVENTION

This disclosure relates to the necessary periodic rebuilding of bowling lanes following normal wear and usage. Because the upper surfaces of a bowling alley are subjected to continuous wear by persons using the alley and the relatively heavy balls and pins which move along these surfaces, it is conventional to resurface the lanes in a periodic maintenance schedule. This normally involves planing or sanding of the lane surfaces. Since a conventional bowling alley is constructed on-site, using tongue and groove boards secured to one another by nails, a lane can be planed or sanded only to a predetermined minimum thickness measured from the underside of the lane to its planar upper surface. This predetermined minimum thickness is normally that thickness at which the nails or fasteners connecting the boards to one another become exposed. After a bowling lane reaches such a condition where metal elements are exposed, it is conventional to rebuild the lane by removing the original boards and replacing them with a substitute board structure of the same fabrication. This involves substantial expense and results in a prolonged period during which the lane is not available for use.

Prior patents relating to bowling lanes have been directed to this general problem. As an example, U.S. Pat. No. 2,039,580 to Borders disclosed a bowling alley having a removable approach portion in the form of a laminated platform which could be shimmed from time to time as its upper surface is planed. In the described embodiment, the platform was held in place by ordinary wood screws covered by a wood plug.

The patents to Grawey, U.S. Pat. No. 2,788,983 and Green, U.S. Pat. No. 3,014,722 each disclose sectional bowling alleys of full thickness, whereby worn sections can be totally replaced when necessary.

The patent to DeVore, U.S. Pat. No. 2,969,973 relates to bowling lane construction and rebuilding of a lane of conventional construction. Rebuilding is accomplished by the use of panels one-half the lane width, clamped to the lane surface and secured by adhesives. The panels are fabricated on-site.

According to this disclosure, a series of full width prefabricated laminated panels are designed to match the wood arrangement on a conventional bowling lane. The panels have a width equal to the width of a bowling lane. Their combined total length is equal to the length of the lane. The lane can be readily rebuilt by overlaying a series of panels along the entire lane surface and securing the panels to the lane surface by an adhesive. Pressure is applied during the curing of the adhesive by temporary metal bolts, which are subsequently removed and replaced by wooden bolts. The wooden bolts are arranged around the periphery of each panel and are held in place by adhesives. Their enlarged heads are subsequently removed and sanded flush with the upper panel surfaces to complete the rebuilding of the lane. In this way, a worn lane can be completely resurfaced to match its original condition without removing or altering the existing lane structure in any way. The resulting lane will have the conventional original total thickness of wood. Because the panels are prefabricated, they can be installed in a minimum amount of time and with a minimum amount of on-site labor. The total cost envisioned in rebuilding a bowling lane in this manner is substantially less than is required to completely rebuild the lane by substituting a total new wood structure of conventional design.

SUMMARY OF THE INVENTION

It is a first object of this invention to provide a relatively inexpensive kit and method for rebuilding a worn bowling lane which has been planed or sanded to a predetermined minimum thickness.

Another object of this invention is to provide a mechanism for rebuilding a bowling lane wherein a substantial amount of the fabrication effort can be accomplished in a production factory, thereby minimizing the utilization of on-site labor. This results in cost savings and a reduction in the amount of time during which the lane is unavailable for play while being rebuilt.

Another object is to provide an effective means for securing overlying panels to a bowling lane without the use of metal fasteners, such as nails or screws.

Another object of the invention is to rebuild a bowling lane to match its original condition without totally replacing the boards in the lane being rebuilt.

These and further objects will be evident from the following disclosure and the accompanying drawings.

DESCRIPTION OF THE PREFERRED EMBODIMENT

Figure 1:
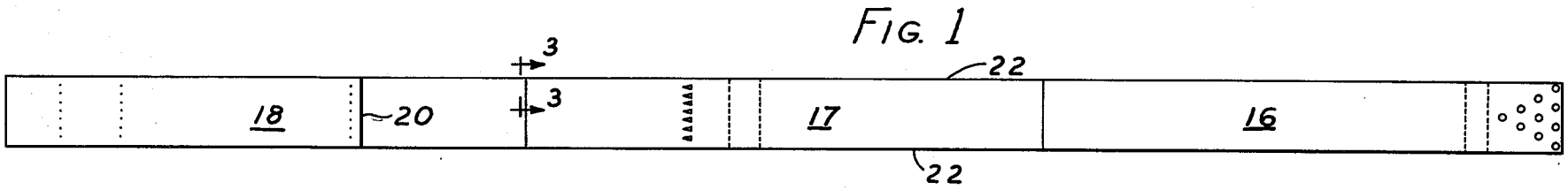
FIG. 1 is a fragmented plan view of a bowling lane which has been rebuilt according to this disclosure.

A conventional bowling lane (see FIG. 2) is constructed on-site by arranging elongated vertical boards 10 across stringers 11 and cross beams 12 supported on a concrete slab or foundation 13. The boards 10 typically include tongue and groove configurations intermediate their height, which interlock mechanically to assist in holding the boards in place. The boards are typically secured to one another by nails, which also secure the boards to the cross members 12. The boards along a bowling lane are conventionally selected from clear grain maple and pine, the maple being used along those portions of the lane subject to substantial wear and pine being used along the intermediate portions of the lane subject only to the rolling of the ball.

Figure 2:
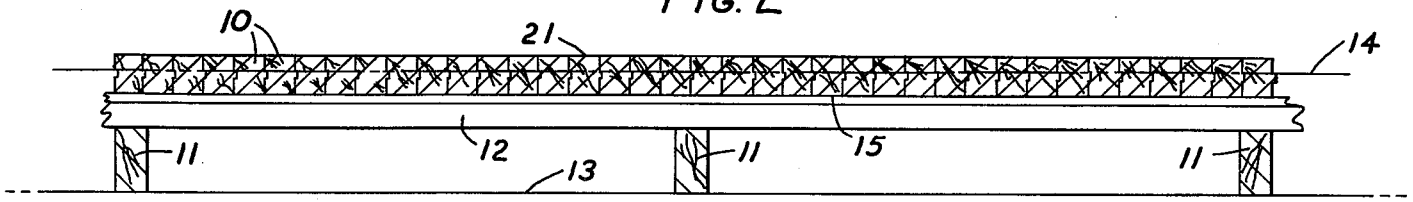
FIG. 2 is a transverse sectional view through a conventional bowling lane.

As a conventional lane becomes worn, it must be periodically resurfaced by planing or sanding. Each time this is accomplished, a minimum thickness of the lane must be removed. This gradually decreases the thickness of the remaining lane structure to that thickness at which the nails or other fasteners holding the boards 10 in place are exposed. When this occurs, the alley must usually be replaced under conventional practices today. In FIG. 2, which illustrates a cross-sectional view of a conventional lane structure, when new, the level at which replacement must be considered is indicated by the dashed line 14. When the upper surface has been planed or sanded to the level shown by dashed line 14, it will be smooth and flat in preparation for the present method for rebuilding the lane. No further preparation of the existing structure is necessary. At that stage, the thickness of the lane will be the predetermined minimum thickness illustrated between dashed line 14 and the lower surfaces 15 across the boards 10. This minimum thickness should be selected so as to not expose metal nails or fasteners which would possibly damage the resurfacing equipment which must be used for lane preparation.

The kit used for rebuilding a lane comprises a series of three prefabricated panels 16, 17 and 18, which are arranged end-to-end along the full length of the lane in the manner shown in FIG. 1. Panel 16 matches the wood requirements at the far end of the lane, including the pit section which supports the bowling pins during play. Panel 17 encompasses the intermediate sections of the lane. Panel 18 matches the wood requirements of the near end of the lane, including the approach, which is defined by a transverse inlaid foul line 20.

Figure 5:
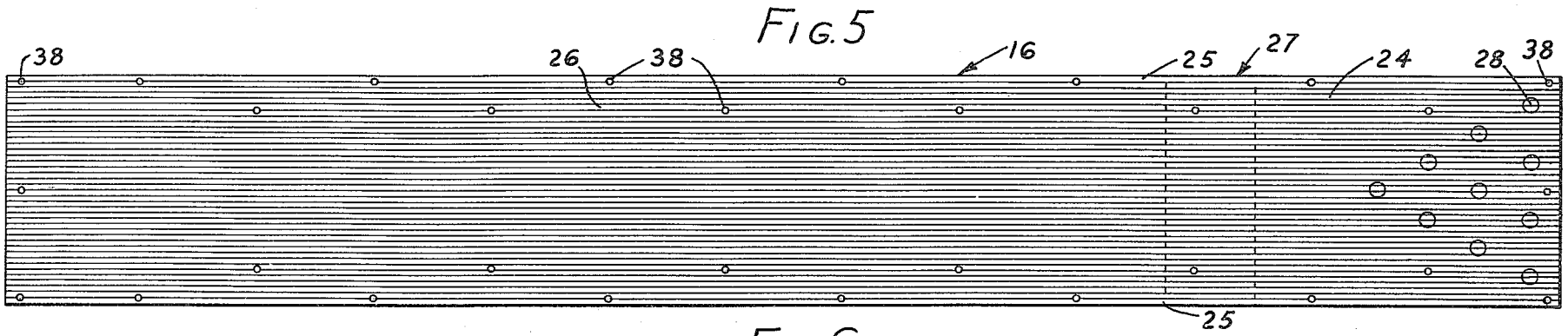
FIG. 5 is a plan view of a first panel including the pit section of a rebuilt bowling lane.
Figure 6:
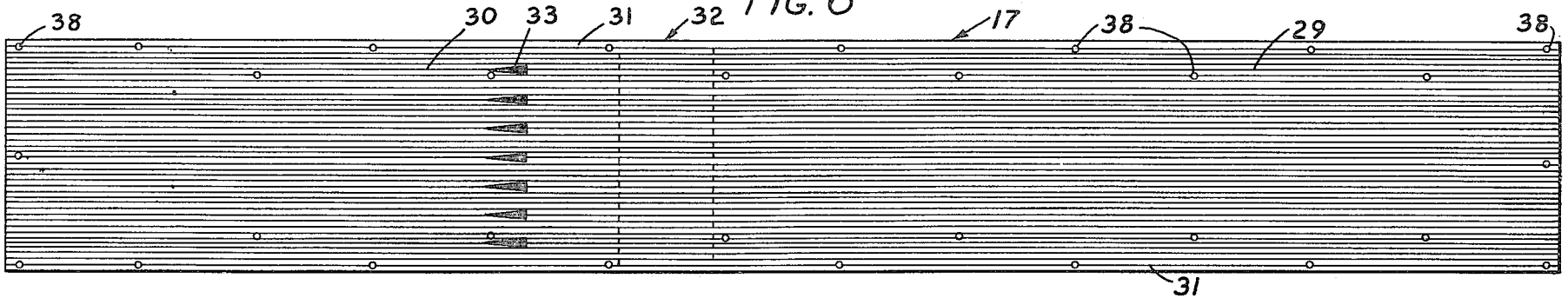
FIG. 6 is a plan view of an intermediate panel.
Figure 7:
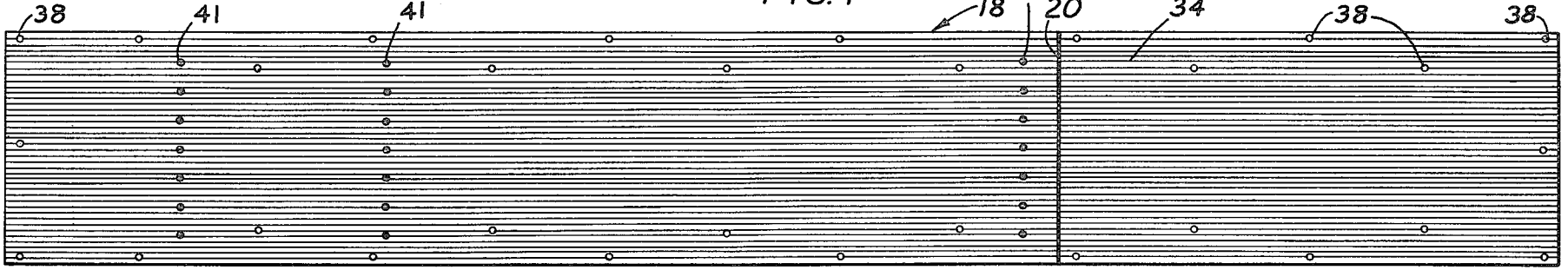
FIG. 7 is a plan view of a final panel, including the lane approach.

The details of the wood laminations in the panels 16, 17 and 18 are illustrated in the plan views designated as FIGS. 5, 6 and 7 respectively.

The three panels are designed for transport and ease of installation. They each have a length of about 26 feet. When laid end-to-end, the combined total length of each series of panels equals the length of the bowling lane rebuilt by them. Since some lanes differ in the length of the approach, it might be necessary to trim off a portion of the near end of panel 18 to match the length of a particular lane. This can be done either in preparation for transport of the panels to the lane, or on-site.

Each panel is constructed of transversely laminated boards having a common width (transverse to the lane structure) and a common thickness (perpendicular to the upperr lane surface). The thickness of each panel is substantially equal to the difference between the original bowling lane thickness between the upper surface 21 and lower surface illustrated in FIG. 2 and the previously discussed minimum thickness illustrated in FIG. 2 between the dashed line 14 and the lower surface 15. In other words, the thickness of the panels equals the total removed thickness between the dashed line 14 and the illustrated upper surface 21 shown in FIG. 2. When the panels are placed over the boards 10 which have been resurfaced to the elevation of dashed line 14, the resulting combined thickness of the boards 10 plus the thickness of the prefabricated panels will again equal the original board thickness of the bowling lane.

Each panel 16, 17 and 18 has a width equal to the original lane width between its side edges 22. The three panels, when laid end-to-end in abutment with one another, are equal in combined total length to the bowling lane length from the near end of the approach section to the far end of the pit section.

The rebuilding kit further comprises a plurality of wooden bolts 38 which are discussed in greater detail below. The panels 16, 17 and 18 are drilled or suitably apertured to receive the wooden bolts in directions perpendicular to the upper and lower panel surfaces. These apertures are arranged about the periphery of each panel to assure adhesive bonding between the panel and the boards 10 without the use of any metal fasteners.

The method for rebuilding the bowling lane first comprises the proper selection of narrow boards of common width and thickness to produce a series of panels 16, 17 and 18 such that the boards within each panel correspond in wood quality and directional characteristics to the boards conventionally arranged along a bowling lane. The boards are preferably selected from the same wood species as are used in the construction of a conventional bowling lane.

The pit section of panel 16 is constructed from maple boards indicated in FIG. 5 by the numeral 24. A maple edge board 25 extends the full length of panel 16 at each side thereof. The remaining boards laminated within panel 16 are chosen of suitable pine and are indicated by the numeral 26. There is a transition area, shown generally at 27, where the maple and pine boards overlap one another or dovetail. Conventional fiber "pin spots" 28 are inlaid in the boards 24 under the usual pin positions.

The intermediate panel 17 is constructed at its far end of pine boards 29 and its near end of maple boards 30. Again, maple edge boards 31 extend the full length of the panel 17 and a transition or dovetail section of overlapping pine and maple boards 28, 30 is indicated at 32. Inlaid bowling targets 33 are properly located for guidance of a bowler using the rebuilt alley surface.

The near panel 18 is constructed entirely from maple boards 34. It includes the inlaid transverse foul line 20, which defines the approach.

The arrangement of maple and pine boards in the respective panels duplicates the usual arrangement of such boards along a conventional bowling lane to provide suitable wear characteristics to the rebuilt lane during bowling usage.

After proper selection of the boards, they are arranged in the panel configurations shown in FIGS. 5, 6 and 7. The panels are built up to have a width equal to the lane width and a length such that the total length of a series of panels, when arranged end-to-end, will equal the conventional lane length. The boards are then bonded within each panel by use of an adhesive applied between the abutting sides and ends of the boards. A suitable wood adhesive can be utilized for this purpose. A thermo-setting adhesive cured with or without application of heat has been found to be effective. No mechanical interconnections or fasteners are used in securing or laminating the boards to one another. In the bonded panel, the respective upper and lower surfaces across the boards in each panel are coplanar because of the common thickness of the boards. The upper and lower panel surfaces are parallel to one another.

The above method steps are preferably accomplished in a laminating assembly area remote from the site of the lane to be rebuilt. The panels 16, 17 and 18 are shipped to the bowling center in the configurations shown in FIGS. 5, 6 and 7 respectively. They are then fully ready for installation.

Assuming that the existing lane structure has been planed or sanded to a planar surface configuration, the panels 16, 17 and 18 are arranged as a series along the upper surface of the lane in abutting end-to-end positions overlying the bowling lane as shown in FIG. 1. The panels 16, 17 and 18 are bonded to the upper surface of the bowling lane by application of an adhesive between the lower surfaces of the panels and the upper surface of the bowling lane. This again is preferably a thermosetting adhesive. The adhesive, or a suitable mastic, should be chosen as one which will bond without application of external heat within a reasonable time (not more than 24 hours).

Figure 4:
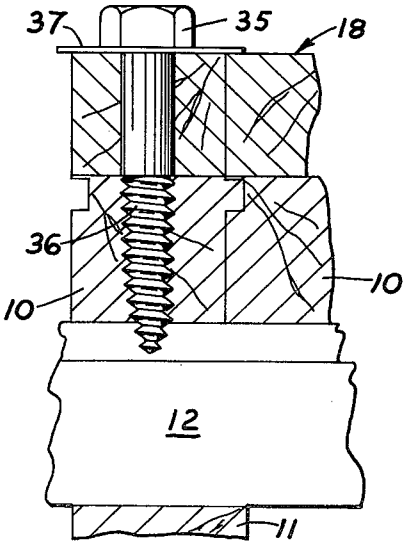
FIG. 4 is a view similar to FIG. 3, showing the use of temporary metal bolts during installation of a panel.

To assure proper adhesive bonding between the panels 16, 17 and 18 and the upper surfaces of the boards 10, it is desirable that perpendicular pressure be applied to the adhesive layer. As shown in FIG. 4, this is achieved by use of threaded metal bolts, commonly known as "lag bolts". Each bolt has an enlarged head 35 and a threaded shank 36 which extends through preformed apertures in the panels 16, 17 and 18. The individual bolts are threadably engaged in the boards 10 of the existing lane. A circular washer 37 is preferably interposed between the enlarged bolt head 35 and the upper surface of the panel through which it is mounted to protect the panel surface from damage and to assure smooth application of pressure. These metal bolts remain in place during the period of time necessary to cure the adhesive which bonds the panels to the existing bowling lane. They are arranged about the periphery of each panel in patterns described specifically below.

Figure 3:
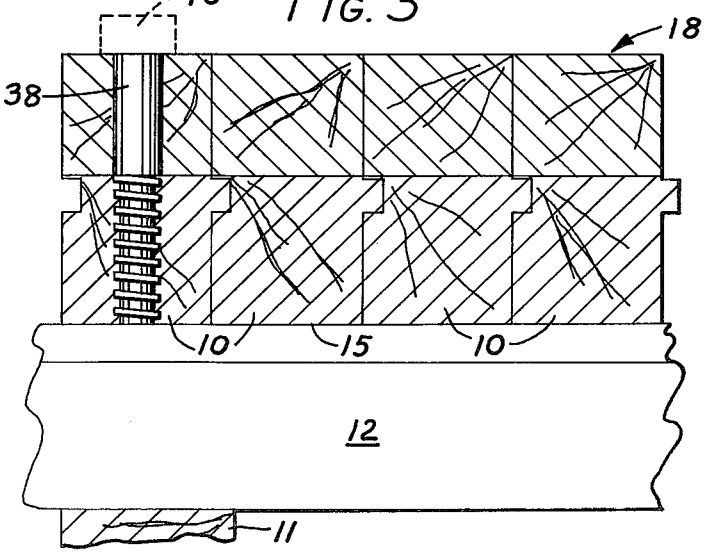
FIG. 3 is an enlarged transverse sectional view taken along line 3—3 in FIG. 1.

After curing of the adhesive layer, the metal bolts are removed and wooden bolts 38 substituted in their place. The wooden bolts threadably engage the boards 10 through the same apertures previously engaged by the metal bolts. The wood bolts also have enlarged upper heads which allow them to be threadably engaged in the boards 10 from the upper surfaces of the panels 16, 17 and 18. It is imperative that the bolts 38 be placed from the top surfaces of the panels, since access is impossible or very limited at the underside of the installed lane. The wood bolts 38 are secured within the apertures in the panels 16, 17 and 18 and within the apertures formed through the boards 10 by a suitable adhesive. After they have been installed and this adhesive has cured, the enlarged upper end of each bolt 38 is removed and sanded smooth to a flush condition coplanar with the upper surfaces of the panels. The enlarged bolt heads which are removed in the finished assembly, are indicated in FIG. 3 by the dashed lines 40.

The wooden bolts 38 provide perpendicular interlocking connections between the existing lane boards 10 and the panels 16, 17 and 18 in an arrangement extended about the periphery of each panel. The wooden bolts 38 can be produced from wood which either matches the boards in a panel or contrasts with the boards, depending upon the positions and utility of bolts 38 in the finished lane structure. As shown in FIG. 5, the panel 16 is bounded along its side edges by staggered wood bolts 38 which match the panel boards within which they are received and therefor visually blend into the panel surface. The ends of panel 16 are secured by three similar wooden bolts arranged in-line, one at each side of the panel and one at its center. Panel 17 is similarly secured by wooden bolts which match the boards within the panel structure. However, panel 18 further includes contrasting wooden bolts arranged along three lines 41 which serve as visible guides in the approach area of the bowling lane. These guides form solid interlocking connections between the panel 18 and the underlying boards 10 to further assure permanent bonding of the panel 18 about the approach area, which is subjected to the greatest amount of wear and board movement during use of the bowling lane.

The prefabricated kit and the described method of rebuilding the lane permits the owner of the bowling center to rebuild the lanes without total reconstruction of them as is presently the case. The rebuilt lane has the bowling characteristics and durability of the original construction. These results can be achieved at a fraction of the cost otherwise required to remove the lane structure and rebuild it in the conventional manner. The installed panels 16, 17 and 18, since they include no metal fasteners or elements, can be periodically resurfaced, planed or sanded as necessary to maintain the proper playing condition of the rebuilt bowling lane. When finally resurfaced to the adhesive line between the panels and the boards 10, the lanes can again be rebuilt by the application of a new set of panels. With proper maintenance it appears that the original boards 10 should never need replacement so long as subsequent panels of prefabricated structure are firmly secured to them.

Having described my invention, I claim:

1. In combination with a bowling lane having worn lane boards resurfaced to a predetermined minimum thickness less than their original thickness, the thickness of the lane boards being measured from their lower surfaces to their resurfaced planar upper surfaces, and the bowling lane having a fixed length and a constant width along such length, the improvement comprising:

a series of prefabricated panels overlying the bowling lane and surface bonded to it by an adhesive, each panel comprising transversely laminated longitudinal boards of common width and thickness bonded to one another by adhesive joints without the utilization of metal fastening members and with the individual boards being parallel to one another, the thickness of each board in the panels being substantially equal to the difference between the original bowling lane thickness and said predetermined minimum thickness, and the respective upper and lower surfaces of the boards across each panel being coplanar and parallel to one another;

each panel having a width equal to the lane width and a length such that the combined total length of a series of panels, when arranged end-to-end, equals the bowling lane length;

a plurality of apertures formed through the panels in directions perpendicular to the upper and lower surfaces thereof, the apertures being arranged both transversely and longitudinally about the periphery of each panel; and a plurality of wooden bolts equal in number to the number of apertures, said wooden bolts being located within said apertures and being threadably engaged within corresponding apertures formed in the lane boards and being bonded by an adhesive between the panel, the wooden bolts, and the lane boards without the utilization of metal fastening members.

2. A method for rebuilding a worn bowling lane following resurfacing of the lane boards to a predetermined minimum thickness less than their original thickness, the thickness of the lane boards being measured from their lower surfaces to their resurfaced planar upper surfaces, the bowling lane having a fixed length and a constant width along such length, said method comprising the following steps:

selecting a plurality of elongated narrow boards of common width and thickness for fabrication of a series of panels such that the boards correspond in wood quality and directional characteristics to the boards conventionally arranged along a bowling lane, the thickness of the boards being substantially equal to the difference between the original bowling lane thickness and said predetermined minimum thickness;

arranging the selected boards in panels, each panel having a width equal to the bowling lane width and a length such that the combined total length of a series of panels, when arranged end-to-end, equals the bowling lane length;

bonding the boards within each panel by use of an adhesive applied between the abutting sides and ends of the boards without the utilization of metal fastening members and with the individual boards parallel to one another, the respective upper and lower surfaces across the boards in each panel being coplanar and parallel to one another, thereby producing a series of prefabricated panels corresponding to the structure of a bowling lane;

arranging a series of the panels along the upper surface of the bowling lane in abutting end-to-end positions overlying the lane boards;

applying an adhesive between the lower surfaces of the panels and the upper surfaces of the resurfaced lane boards;

applying temporary pressure between the panels and the bowling lane during curing of the adhesive by application of a plurality of threaded metal bolts having enlarged upper ends abutting the upper surfaces of the panels, each bolt being extended through an aperture formed through a panel and being threadably engaged in the resurfaced lane boards beneath the panel, the bolts being arranged in a pattern extending both transversely and longitudinally about the periphery of each panel;

removing the metal bolts after curing of the adhesive between the panels and the lane; and substituting wooden bolts in place of the removed metal bolts, the wooden bolts being threadably secured to the lane boards and being further secured to both the panels and the lane boards by application of an adhesive bond between each wooden bolt and the surfaces engaged thereby for assisting in maintaining each panel on the lane boards without the utilization of metal fastening members.

3. A method for rebuilding a worn bowling lane following resurfacing of the lane boards to a predetermined minimum thickness less than their original thickness, the thickness of the lane boards being measured from their lower surfaces to their resurfaced planar upper surfaces, the bowling lane having a fixed length and a constant width along such length, said method comprising the following steps:

selecting a plurality of elongated narrow boards of common width and thickness for fabrication of a series of panels such that the boards correspond in wood quality and directional characteristics to the boards conventionally arranged along a bowling lane, the thickness of the boards being substantially equal to the difference between the original bowling lane thickness and said predetermined minimum thickness;

arranging the selected boards in panels, each panel having a width equal to the bowling lane width and a length such that the combined total length of a series of panels, when arranged end-to-end, equals the bowling lane length;

bonding the boards within each panel by use of an adhesive applied between the abutting sides and ends of the boards without the utilization of metal fastening members and with the individual boards parallel to one another, the respective upper and lower surfaces across the boards in each panel being coplanar and parallel to one another, thereby producing a series of prefabricated panels corresponding to the structure of a bowling lane;

arranging a series of the panels along the upper surface of the bowling lane in abutting end-to-end positions overlying the lane boards;

applying an adhesive between the lower surfaces of the panels and the upper surfaces of the resurfaced lane boards;

applying temporary pressure between the panels and the bowling lane during curing of the adhesive;

arranging a plurality of threaded wooden bolts through apertures formed through each panel, the bolts being threadably engaged in the resurfaced lane boards beneath the panel;

and securing the wooden bolts to both the panels and the lane boards by application of an adhesive bond between each wooden bolt and the surfaces engaged thereby for assisting in maintaining each panel on the lane boards without the utilization of metal fastening members.

* * * * *